US007337809B2

(12) United States Patent
Vanderjeugt et al.

(10) Patent No.: US 7,337,809 B2
(45) Date of Patent: Mar. 4, 2008

(54) METHOD AND DEVICE FOR WEAVING FABRICS PROVIDED WITH ZONES WITH FLOATING PILE ACROSS SEVERAL WEFT YARNS

(75) Inventors: Bram Vanderjeugt, Ieper (BE); Jozef Verschelde, Anzegem (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 11/267,827

(22) Filed: Nov. 4, 2005

(65) Prior Publication Data

US 2007/0102057 A1 May 10, 2007

(30) Foreign Application Priority Data

Nov. 4, 2004 (BE) ..... 2004/0536

(51) Int. Cl.
*D03D 39/16* (2006.01)
*D03D 39/00* (2006.01)
*D03C 13/00* (2006.01)

(52) U.S. Cl. ..... 139/21; 139/37; 139/55.1; 139/391; 139/402

(58) Field of Classification Search ..... 139/21, 139/37, 55.1, 391, 402
See application file for complete search history.

(56) References Cited

U.S. PATENT DOCUMENTS 5,158,118 A * 10/1992 Tate et al. ..... 139/383 A
6,186,186 B1 * 2/2001 Debaes et al. ..... 139/21
6,581,646 B2 * 6/2003 Dewispelaere ..... 139/455
7,086,424 B2 * 8/2006 Debaes et al. ..... 139/418
2002/0079012 A1 * 6/2002 Dewispelaere ..... 139/55.1
2004/0079433 A1 * 4/2004 Bassi et al. ..... 139/55.1
2005/0081940 A1 * 4/2005 Vanthoumout et al. .... 139/55.1

FOREIGN PATENT DOCUMENTS

BE 1008131 1/1996
EP 459582 12/1991

* cited by examiner

*Primary Examiner*—Gary L. Welch
*Assistant Examiner*—Robert H Muromoto, Jr.
(74) *Attorney, Agent, or Firm*—James Creighton Wray; Clifford D. Hyra

(57) ABSTRACT

While weaving fabrics (501, 502, 601, 602) on a weaving machine, in successive weft insertion cycles two weft yarns (505, 506, 605, 606) are simultaneously inserted at different weft insertion levels between pile warp yarns (520, 530, 620, 630) which are positioned with respect to the weft insertion levels by a three-position-non-open-shed Jacquard machine. The Jacquard machine is provided to maintain one or several pile warp yarns (503, 504, 603, 604) in successive operating cycles of the weaving machine in an upper and/or a lower position. The pile warp yarns (503, 504, 603, 604) in their upper or in their lower position are positioned between the weft insertion levels. Furthermore, a three-position-non-open-shed Jacquard machine and a weaving machine are provided to carry out such a method, and a method to rearrange the harness suspension of a three-position-non-open-shed Jacquard machine.

21 Claims, 4 Drawing Sheets

METHOD AND DEVICE FOR WEAVING FABRICS PROVIDED WITH ZONES WITH FLOATING PILE ACROSS SEVERAL WEFT YARNS

BACKGROUND OF THE INVENTION

This application claims the benefit of Belgian Application No. 2004/0536 filed Nov. 4, 2004, which is hereby incorporated by reference in its entirety.

The invention relates, first of all, to a method for weaving fabrics on a weaving machine, wherein in successive weft insertion cycles two weft yarns are simultaneously inserted at a different weft insertion level between pile warp yarns which are positioned by means of a three-position-non-open-shed Jacquard machine, wherein this Jacquard machine is provided to maintain one or several pile warp yarns in successive operating cycles of the weaving machine in an upper and/or lower position.

Secondly, the invention relates to a three-position-non-open-shed Jacquard machine, wherein the Jacquard machine is provided for positioning pile warp yarns such that two weft yarns are simultaneously inserted at a different weft insertion level between the said pile warp yarns by means of a weaving machine in successive weft insertion cycles, and wherein the Jacquard machine is provided to maintain one or several pile warp yarns in successive operation cycles of the weaving machine in an upper and/or a lower position.

Thirdly, the invention relates to a Jacquard weaving machine, more specifically a face-to-face double-rapier weaving machine, which is provided to carry out a method according to the invention.

Lastly, the invention relates to a method to rearrange the harness suspension of a three-position-non-open shed Jacquard machine, wherein the harness suspension is provided with heddles for positioning pile warp yarns of one or several frames, wherein two weft yarns are simultaneously inserted between the said pile warp yarns at a different weft insertion level by a weaving machine in successive weft insertion cycles, and which is provided to maintain the pile warp yarns of one or several frames in successive operating cycles of a weaving machine in an upper and/or a lower position.

There is a strong tendency to realize fabrics having different structures within the same fabric.

In patent application EP 1 347 087 a method and a device are described to manufacture fabrics using face-to-face weaving techniques comprising a large variety of structures. Thus an almost infinite number of combinations is possible of cut pile with loops and with warp yarns forming patterns which are interlaced across one or several weft yarns, so-called flat weave or likewise called fabrics with floating pile across several weft yarns. In order to produce such fabrics especially adapted machines are required: three-rapier weaving machines equipped with two rows of spacers which have to meet certain specific requirements as to form, and the machine should likewise be equipped with a universal (open shed) 4-position Jacquard machine.

Such machines provide quite some possibilities, but they have the disadvantage that most of the time they will require a specific investment in new machines.

Fabrics having no zones with a loop pile, but containing zones with flat weave, also present large possibilities to provide structural variations in a pile fabric.

In patent application EP 0 459 582, a double-rapier weaving machine with a non-open-shed Jacquard machine is described, allowing fabrics to be produced with cut pile and with zones with flat weave woven in a ½V-weave. In doing so, however, pattern forming of the flat weave should be restricted to pattern forming warp yarns to be situated every two weft yarns only on the pile face. Here, floating pile running across several weft yarns is not possible, because the non-open-shed Jacquard machine, as known from the state-of-the-art does not allow for movements, in which it is possible to maintain the central position between the two rapiers during two successive weft insertion cycles.

Therefore, a universal (open-shed) three-position Jacquard machine is required. This machine, however, will have the inherent disadvantage that per outgoing harness cord and therefore per pile warp yarn to be controlled, two actuators (for instance solenoids) will be required. Jacquard machines having two solenoids per outgoing harness cord are expensive and therefore they are not so readily available on the market.

By means of a non-open-shed-three-position Jacquard machine, fabrics may be woven however on a double rapier weaving machine presenting a combination of cut pile and zones with flat weave, wherein in the zones with flat weave the pattern forming warp yarn is floating across several weft yarns, this when by means of weft cancellation or weft disengaging at each insertion only one weft is inserted in the so-called ¼V-weave.

The disadvantage of this method is that it is less productive, as per weft insertion cycle of the machine only one weft is applied in a useful manner.

The purpose of the invention is to provide a method and a device for weaving fabrics on a weaving machine having two weft insertion levels and which is equipped with a three-position-non-open-shed Jacquard machine, wherein one or several zones with floating pile across several weft yarns may be woven.

SUMMARY OF THE INVENTION

The purpose of the invention is achieved on the one hand by providing a method for weaving fabrics on a weaving machine, wherein in successive weft insertion cycles two weft yarns are simultaneously inserted on different weft insertion levels between pile warp yarns which are positioned with respect to the weft insertion levels by means of a three-position-non-open shed Jacquard machine, wherein this Jacquard machine is provided to maintain one or several pile warp yarns in successive operating cycles of the weaving machine in an upper and/or a lower position, and wherein the said pile warp yarns in their upper or in their lower position are positioned between the weft insertion levels.

In this manner a pile warp yarn that is maintained in its upper or lower position at a first and a second weft, will also in the central position be maintained between the weft insertion levels in the fabric, through which the possibility is created to make the pile warp yarns to float across several weft yarns, and through which therefore two or more zones with floating pile across several weft yarns may be created.

Because of the fact that, in order to form one or several zones with floating pile across several weft yarns in the lower fabric, it should be possible for this pile warp yarn in the lower fabric to be woven-in or interlaced (weaving-in means to be concealed as a dead pile in the lower fabric), this pile warp yarn should be able to carry out the motion from a position between the weft insertion levels (which is the central position with respect to the weft insertion levels) to a position below the weft insertion levels in the lower fabric. Furthermore, in order to form floating pile across several weft yarns in the upper fabric, it has to be possible to weave in or to interlace a pile warp yarn in the upper fabric, through which this pile warp yarn should be able to make the movement from a position between the weft insertion levels (which is the central position with respect to the weft insertion levels) to a position above the weft insertion levels in the upper fabric.

Therefore, for weaving face-to-face at least a first part of the said pile warp yarns is positioned in their upper position between the weft insertion levels, and at least a second part of the said pile warp yarns is positioned in their lower position between the weft insertion levels.

To form zones with floating pile across several weft yarns on the back of the upper fabric, the pile warp yarns of the second part, at a first weft, are positioned in a central position which corresponds with a position of the pile warp yarns above the weft insertion levels, and at a second weft they will be positioned in an upper position which corresponds with an uppermost position of the pile warp yarns with respect to the weft insertion levels.

To form zones with floating pile across several weft yarns on the back of the lower fabric, at a first weft the pile warp yarns are positioned in a central position which corresponds with a position of the pile warp yarns below the weft insertion levels, and at a second weft they will be positioned in an lower position which corresponds with an lowermost position of the pile warp yarns with respect to the weft insertion levels.

In this manner, text and logograms may be woven on the back of the fabric.

However, when the weaving machine is not suitable to realize this uppermost and lowermost position of the pile warp yarns with respect to the weft insertion levels, the positions of the pile warp yarns corresponding with this lowermost and uppermost positions are disengaged, or adjusted as not possible to be selected when the Jacquard machine is controlled. In this case mentioned here, it is then impossible to make the pile to float also on the back across several weft yarns, and it will only be possible to make the pile to float across several weft yarns on the face of the fabric.

In a preferred method according to the invention, when weaving face-to-face, at least a third part of the pile warp yarns are alternately interlaced across weft yarns in the backing fabric of the upper or lower fabric to form pile, wherein the pile forming pile warp yarns between both fabrics are cut through, such that two fabrics with at least one zone with cut pile are formed.

On the other hand, the purpose of the invention is achieved by providing a three-position-non-open-shed Jacquard machine, wherein the Jacquard machine is provided for positioning pile warp yarns such that two weft yarns are simultaneously inserted at a different weft insertion level between the said pile warp yarns by means of a weaving machine in successive weft insertion cycles, and wherein the Jacquard machine is provided to maintain one or several pile warp yarns in successive operating cycles of the weaving machine in an upper and/or a lower position, but wherein the Jacquard machine is provided to position the said pile warp yarns in their upper or in their lower position between the weft insertion levels.

In a preferred embodiment of a three-position-non-open-shed Jacquard machine according to the invention, with face-to-face weaving, the harness of the Jacquard machine which is provided to position the pile warp yarns are divided into:

a first and a second part of the harness comprising heddles for positioning a first and a second part of pile warp yarns to form zones with floating pile across several weft yarns, wherein the harness cords of the first part of the harness for positioning the first part of the pile warp yarns destined for the lower fabric are suspended in such a manner that the three positions lower, central and upper of the warp yarns are lowered by one position with respect to the corresponding pile warp yarns of the third part of the warp yarns, and the second part of the harness for positioning the second part of the pile warp yarns destined for the upper fabric, will be suspended in such a manner that the three positions lower, central and upper, of the pile warp yarns are raised by one position with respect to the corresponding pile warp yarns of the third part of the pile warp yarns;

a third part of the harness, comprising heddles for positioning a third part of the pile warp yarns in order to form cut pile.

In a preferred embodiment of a three-position-non-open-shed Jacquard machine according to the invention, the said first part of the pile warp yarns is controlled by the part of the Jacquard machine equipped with a stationary grid, and the said second part of the pile warp yarns is controlled by the part of the Jacquard machine with the movable grid.

Furthermore, the purpose of the invention is achieved by providing a weaving machine, more specifically a face-to-face double-rapier weaving machine, the weaving machine being provided for carrying out a method according to the invention.

Finally, the purpose of the invention is achieved by providing a method for rearranging the harness suspension of a three-position-non-open-shed Jacquard machine, wherein the harness suspension is provided with heddles to position pile warp yarns of one or several frames, wherein two weft yarns are inserted simultaneously by a weaving machine in successive weft insertion cycles at a different weft insertion level between the said pile warp yarns and which is provided to maintain the pile warp yarns of one or several frames in successive operating cycles of the weaving machine in an upper and/or a lower position, but wherein the harness suspension is provided such that the pile warp yarns of the one or several frames which are maintained in the upper and/or lower position are lowered or raised respectively by one position of the pile warp yarn.

In a preferred method to rearrange the suspension of the harness of a three-position-non-open-shed Jacquard machine according to the invention, the heddles of the warp yarns of the one or several pile warp yarns will be replaced by heddles, the heddle eyes of which are lowered or raised respectively by the distance of one position of the pile warp yarns.

Thereby, for weaving one or several zones with floating pile across several weft yarns for the lower fabric, the heddles of the pile warp yarns of the said one or several frames may be replaced, on the one hand, by heddles, the heddle eyes of which are situated lower by one position of the pile warp yarn, whereas on the other hand, for weaving one or more zones with floating pile across several weft yarns for the upper fabric, the heddles of the pile warp yarns of the one or several frames may be replaced by heddles, the heddle eyes of which are situated higher by one position of the pile warp yam.

On the other hand, the pile warp yarns of at least one frame of the said frames may be suspended to a sectional part, adjustable as to height, in order to lower, respectively raise by one position the warp yarns of the said frame which may be maintained in the upper and/or the lower position, through which the pile yarns of this at least one frame in a first situation of the adjustable sectional part may be used to extend between the lower fabric and the upper fabric (501, 601), and in a second situation of the adjustable sectional part may be used to float across several weft yarns in the upper or lower fabric.

In case the pile warp yarns of this frame thereby are connected to the movable grid of the Jacquard machine, this sectional part is provided to be adjusted upwards by one position when rearranging it from being used as cut pile to its use as floating pile across several weft yarns in the upper fabric.

However, when the pile warp yarns of this frame thereby are connected to the stationary grid, this sectional part is provided to be adjusted downwards by one position when rearranging it from being used as cut pile to its use as floating pile across several weft yarns in the lower fabric.

The rearrangement of the profile may thereby occur manually per frame, or this may occur by means of a drive per frame or simultaneously for several frames.

The drive can thereby be manually operated, or is operated by the controller of the machine.

Controlling may occur by electro-hydraulic, electro-pneumatic or electromechanical means.

In the following detailed description, the characteristics and advantages mentioned above of a method and a device for weaving fabrics having zones with floating pile across several weft yarns according to the invention will be further clarified. This description is only intended to clarify the general principles of the present invention, therefore no part of this description may be interpreted as a restriction of the field of application of the invention or the patent rights demanded for in the claims.

In this description reference is made by means of reference numbers to the attached FIGS. 1 through 9 which, on the one hand, are representing a number of different motional possibilities according to the invention which may be carried out on a face-to-face double-rapier weaving machine provided with a three-position-non-open-shed Jacquard machine, and which on the other hand are representing the tackle system and the options of a three-position-non-open-shed Jacquard machine according to the invention in which:

DETAILED DESCRIPTION OF THE PREFERRED EMBODIMENTS

On a weaving machine which is provided to insert two weft yarns simultaneously on different weft insertion levels, and which is equipped with a three-position-non-open-shed Jacquard machine according to the state-of-the-art, this three-position-non-open-shed Jacquard machine enables a pile warp yam to reach three positions in a fabric with respect to the weft insertion levels, i.e. a position (B) above the weft insertion levels, a position (O) below the weft insertion levels and a position between the weft insertion levels, which is called the central position (M). The heddle eyes of the Jacquard heddles of the harness of a three-position-non-open-shed Jacquard machine according to the state-of-the-art, are able to reach three positions. This is expressed in an abbreviated manner in this patent application as it being possible that the pile warp yarns can be positioned in three positions. Moreover, such a three-position-non-open-shed Jacquard machine is provided to maintain one or several pile warp yarns in an upper and/or a lower position in successive operating cycles of the weaving machine.

Now, when on a weaving machine which has been provided to insert two weft yarns simultaneously at a different weft insertion level and which has been provided with a three-position-non-open-shed Jacquard machine, as described before, it has to be possible to produce fabrics having one or several flat weave zones, one or several pile warp yarns forming floating pile across several weft yarns, it should be possible to reach the upper (B) or lower (O) and central (M) positions with respect to the weft insertion levels, the central position (M) having to be reached at each weft.

Therefore, in this invention, a method is provided as indicated above, the said warp yarns in their upper or in their lower positions being positioned in the centre (M) between the weft insertion levels.

As represented in the FIGS. 1*a*, 1*b*, 2*a* and 2*b*, to that purpose, the pile warp yarn positions-which according to the-state-of-the-art (FIG. 1*a* and FIG. 1*b*) are corresponding with the upper (B), central (M) and lower (O) positions, are raised or lowered by one pile warp yarn position with respect to the weft insertion levels, because of which it will be possible, at each weft, to maintain the warp yarns in the central position (M) between the weft insertion levels (arrow a in the FIGS. 2*a* and 2*b*), and it will therefore be possible to form several zones in the fabrics having floating pile across several weft yarns.

Figure 1A:
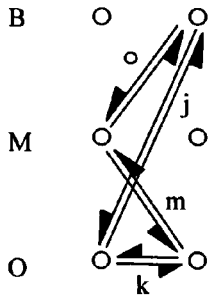
FIG. 1*a* is representing the motional possibilities of the Jacquard heddles of the harness part of a three-position-non-open-shed Jacquard machine according to the state-of-the-art for weaving pile fabrics, the Jacquard heddles being provided to position pile warp yarns which are woven in the lower fabric as a dead pile (harness part with movable grid), applied to fabrics according to the invention for one or several frames in order to form cut pile.
Figure 1B:
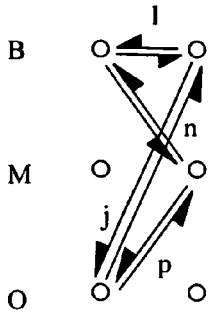
FIG. 1*b* is representing the motional possibilities of the Jacquard heddles of the harness part of a three-position-non-open-shed Jacquard machine according to the state-of-the-art for weaving pile fabrics, the Jacquard heddles being provided to position pile warp yarns which are woven in the upper fabric as a dead pile (harness part with stationary grid), applied to fabrics according to the invention for one or several frames in order to form cut pile.
Figure 2A:
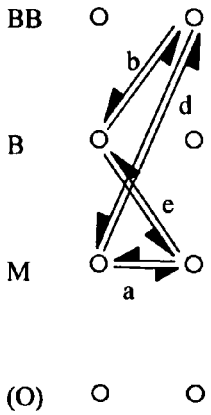
FIG. 2*a* is representing the motional possibilities of the Jacquard heddles of the harness part of a three-position-non-open-shed Jacquard machine which, in fabrics realized by means of the method according to the invention, are positioning the pile warp yarns of the frames used in the upper fabric for weaving zones with floating pile across several weft yarns, when all motions may be physically performed on the weaving machine (harness part with movable grid)
Figure 2B:
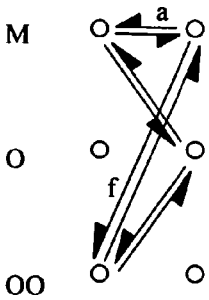
FIG. 2*b* is representing the motional possibilities of the Jacquard heddles of the harness part of a three-position-non-open-shed Jacquard machine which, in fabrics realized by means of the method according to the invention, are positioning the pile warp yarns of the frames used for weaving zones with floating pile across several weft yarns in the lower fabric, when all the motions may be physically performed on the weaving machine (harness part with stationary grid)
Figure 8:
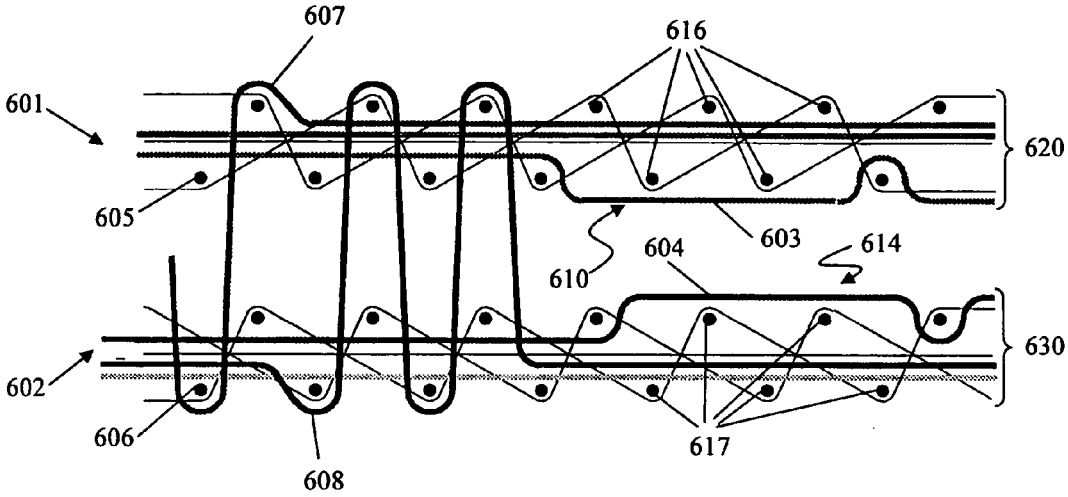
FIG. 8 is representing a fabric realized by face-to-face weaving according to the invention in which zones are being found in both fabrics where the pile is floating across several weft yarns on the pile face of the fabric.
Figure 9:
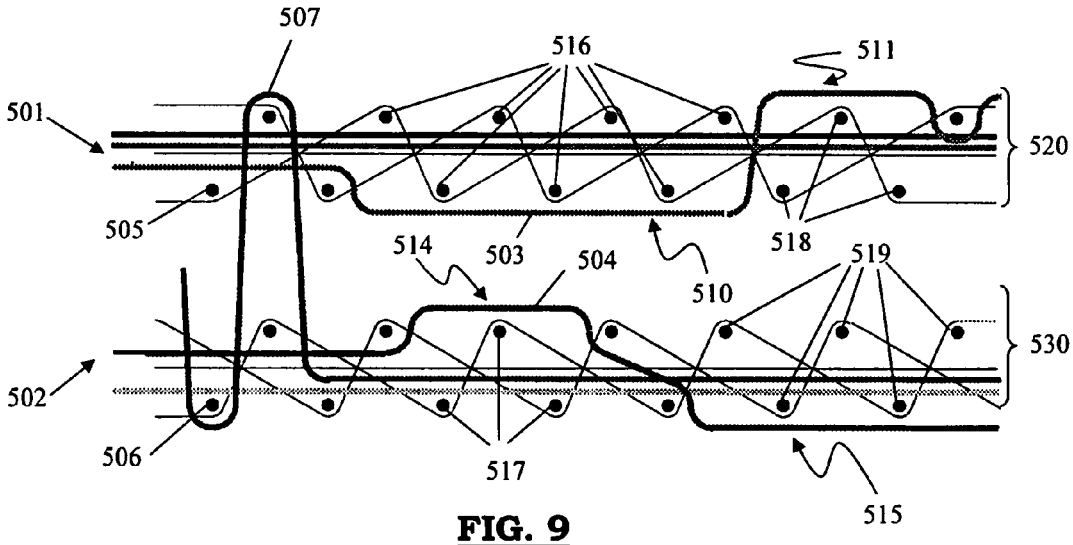
FIG. 9 is representing a fabric realized by face-to-face weaving according to the invention in which zones are being found in both fabrics where the pile is floating across several weft yarns both on the pile face and on the back of the fabric.

When this principle is applied when weaving face-to-face fabrics, as represented in the FIGS. 2*a* and 2B and in the FIGS. 8 and 9, then at least a first part (504, 604) of the pile warp yarns will be positioned in their upper position between the weft insertion levels, in order to be able to form one or several zones (514, 515, 516) having floating pile across several weft yarns (517, 519, 617) in the lower fabric (502, 602), and at least a second part (503, 603) of the pile warp yarns will be positioned in their lower position between the weft insertion levels in order to be able to form one or more zones (510, 511, 610) with floating pile across several weft yarns in the upper fabric (501, 601). Therefore, the three positions which this first part (504, 604) and this second part (503, 603) of the pile warp yarns are able to take up will become:

for the second part (503, 603) of the warp yarns destined for the upper fabric (501, 601) are raised by one position, such that the positions centre (M), upper (B) and uppermost (BB) of the pile warp yarns (503, 603) with respect to the weft insertion levels are created, as represented in FIG. 2*a*; and for the first part (504, 604) of the warp yarns destined for the lower fabric (502, 602) is lowered by one position, such that the positions centre (M), lower (O) and lowermost (OO) of the pile warp yarns (504, 604) with respect to the weft insertion levels are created as represented in FIG. 2*b*.

In this manner, the central position. (M) between the weft insertion levels may be maintained (arrow a)) at the successive wefts, as represented in the FIGS. 2*a* and 2*b*, because of which one or several zones (501, 511, 610, 514, 515, 614) having floating pile across several weft yarns (516, 518, 616, 517, 519, 617) may be woven as represented in the FIGS. 8 and 9.

As may be deducted from the figures, by lowering, raising respectively, by one warp yarn position, the positions of a three-position-non-open-shed Jacquard machine according to the state-of-the-art, the harness suspension of the three-position-non-open-shed Jacquard machine being provided to weave in dead pile in the backing fabric of the lower fabric (502, 602), and the upper fabric (501, 601) respectively (see FIGS. 1*a*, 1*b* respectively), the positions obtained which are necessary to weave the zones (510, 511, 610), (514, 515, 614) respectively, with floating pile across several weft yarns (516, 518, 616), (517, 519, 617) respectively in the upper fabric (501, 601) (FIG. 2*a*), the lower fabric (502, 602), (FIG. 2*b*). The lower position (O) of the warp yarns with respect to the weft insertion levels of FIG. 2*a*, and the upper position (B) of the warp yarns with respect to the weft insertion levels of FIG. 2*b*, are therefore positions which can no longer be obtained.

Figure 3A:
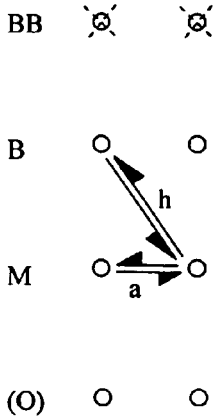
FIG. 3*a* is representing the motional possibilities of the Jacquard heddles of the harness part of a three-position-non-open-shed Jacquard machine which, in fabrics realized by means of the method according to the invention, are positioning the pile warp yarns of the frames used in the upper fabric for weaving zones with floating pile across several weft yarns in case the uppermost position can not be realized on the weaving machine (harness part with movable grid)

By creating the lowermost position (OO) and the uppermost position (BB) of the pile warp yarns (504, 604) and (503, 603) respectively with respect to the weft insertion levels, it will be possible to realize one or several zones (511, 515) with floating pile across several weft yarns (518, 519) on the back of a fabric (501, 502), enabling text and logograms to be woven on the back of fabrics (501, 502), for instance carpets. This text and these logograms will not necessarily be the same for upper and lower fabric (501, 502). The motions of the warp yarns (503, 504) in the fabrics (501, 502) which are produced to that effect are situated between a upper position (B) and an uppermost position (BB) (arrow b) with respect to the weft insertion levels for the upper fabric (501) and between a lower position (O) and a lowermost position (OO) (arrow c) with respect to the weft insertion levels for the lower fabric (502). The motions of the warp yarns (503, 504) in the upper fabric (501) between the central position (M) and the upper position (B) (arrow e,h) as represented in the FIGS. 2*a* and 3*a*, are the motions in which the pile warp yarns are interlaced in the upper fabric (501) as dead pile.

Figure 3B:
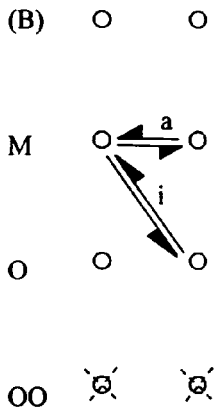
FIG. 3*b* is representing the motional possibilities of the Jacquard heddles of the harness part of a three-position-non-open-shed Jacquard machine which, in fabrics realized by means of the method according to the invention, are positioning the pile warp yarns of the frames used in the lower fabric for weaving zones with floating pile across several weft yarns in case the lowermost position can not be to realized on the weaving machine (harness part with stationary grid)

The motions of the warp yarns in the lower fabric (502) between the central position (M) and the lower position (O) (arrow g,i), as represented in the FIGS. 2*b* and 3*b*, are the motions in which the pile warp yarns are interlaced in the lower fabric (502) as dead pile.

FIG. 9 is representing an example of a face-to-face fabric, i.e. an upper fabric (501) and a lower fabric (502) according to the invention, in which, per cycle, two weft yarns, i.e. a first weft yarn (505) and a second weft yarn (506) are inserted at two different weft insertion levels in the fabrics (501) and (502) respectively, between pile warp yarns, i.e. a second series of pile warp yarns (520) for the upper fabric (501) and a first series of pile warp yarns (530) for the lower fabric (502). In both fabrics (501) and (502) respectively, by means of one pile warp yarn (503) and (504) respectively, a zone with floating pile across several weft yarns (516, 517) and (518, 519) respectively is formed both at the face (=pile face) and at the back of each fabric (501, 502).

In case the weaving machine is not provided to carry out the extreme motions of the pile warp yarns (503, 504), then this uppermost (BB) and this lowermost (OO) position of the warp yarns (503, 504) with respect to the weft insertion levels are disengaged or prevented from being selected when activating the Jacquard machine. The possible positions that may be realized in such Jacquard machines are represented in the FIGS. 3*a* and 3*b*. Consequently, with such a device, therefore, it will not be possible to form zones (511, 513) with floating pile across several yarns (518, 519) on the back of the upper and lower fabrics (501, 502).

In FIG. 8 an example is represented of a face-to-face fabric, i.e. an upper fabric (601) and a lower fabric (602) according to the invention, in which, per cycle, two weft yarns are inserted, i.e. a first weft yarn (605) and a second weft yarn (606) at two different weft insertion levels in the fabrics (601) and (602) respectively between pile warp yarns, i.e. a second series of pile warp yarns (602) for the upper fabric (601), and a first series of pile warp yarns (630) for the lower fabric (602). In both fabrics (601, 602), by means of one pile warp yarn (603) and (604) respectively, a zone (610) and (611) respectively, with floating pile across several weft yarns (616) and (617) respectively, is formed on the face of each fabric (601) and (602) respectively.

As represented in the FIGS. 3*a* and 3*b*, in addition to the possibility to maintain the central (M) position across several weft yarns (518, 519), there still remain the motional possibilities between the central position (M) and the upper position (B) (arrow h) for the upper fabric (601), as represented in FIG. 3*a*, and between the central position (M) and the lower position (O) (arrow i) for the lower fabric (602), as represented in FIG. 3*b*. With these positions the non-active pile may be woven in the upper fabric (601), the lower fabric (602) respectively.

When in the upper and lower fabric (501, 601) and (502, 602) respectively at least one zone having cut pile has to be formed, then a third part of the pile warp yarns (507, 607, 608) will be interlaced alternately in the backing fabric of the upper and lower fabric (501, 601) and (502, 602) respectively, because of which they will form a pile (see FIGS. 8 and 9). The motions of the pile warp yarns (507, 607, 608) which are carried out in the fabrics (501, 601) and (502, 602) respectively, take place between an upper position (B) and a lower position (O) (arrow j), as represented in the FIGS. 1*a* and 1*b*. The pile forming pile warp yarns (507, 606, 608) between the two fabrics (501, 601) and (502, 602) respectively are then cut through. The motions of the pile warp yarns, which are carried out between a lower position (O) and a lower position (O) (arrow k) (FIG. 1*a*) are the motions for weaving the floating pile across several weft yarns on the back of the lower fabric (502, 602), whereas the motions of the pile warp yarns which are carried out in the upper fabric (501, 601) between an upper position (B) and an upper position (B) (arrow 1) (FIG. 1*b*) are the motions for weaving floating pile across several weft yarns on the back of the upper fabric (501, 601). The motions of the pile warp yarns, which are carried out in the lower fabric (502, 602) between a lower position (O) and a central position (M) (arrow m) (FIG. 1*a*) are the motions for weaving in the dead pile in the backing fabric of the lower fabric (502, 602), whereas the motions of the pile warp yarns, which are carried out in the upper fabric (501, 601) are carried out between an upper position (B) and a central position (M) (arrow n) (FIG. 1*b*) are the motions for weaving in dead pile in the backing fabric of the upper fabric (501, 601). The motions of the pile warp yarns, which are carried out in the upper fabric (501, 601) between the central position (M) and the lower position (O) (arrow p) (FIG. 1*b*), and between the central position (M) and the upper position (B) (arrow o) in the lower fabric (502, 602) (FIG. 1*a*), are motions which may be used to make a pile warp yam, which is woven in as a dead pile, directly to form a pile.

In order to carry out such a method according to the invention on a three-position-non-open-shed Jacquard machine, the Jacquard machine being provided for positioning warp yarns in such a manner that two weft yarns are inserted simultaneously by a weaving machine in successive operating cycles at a different weft insertion level between the said warp yarns, and the Jacquard machine being provided to maintain one or several pile warp yarns across several weft yarns in an upper and/or a lower position, the Jacquard machine is provided to position the said warp yarns in their upper and/or lower position between the weft insertion levels.

Figure 5:
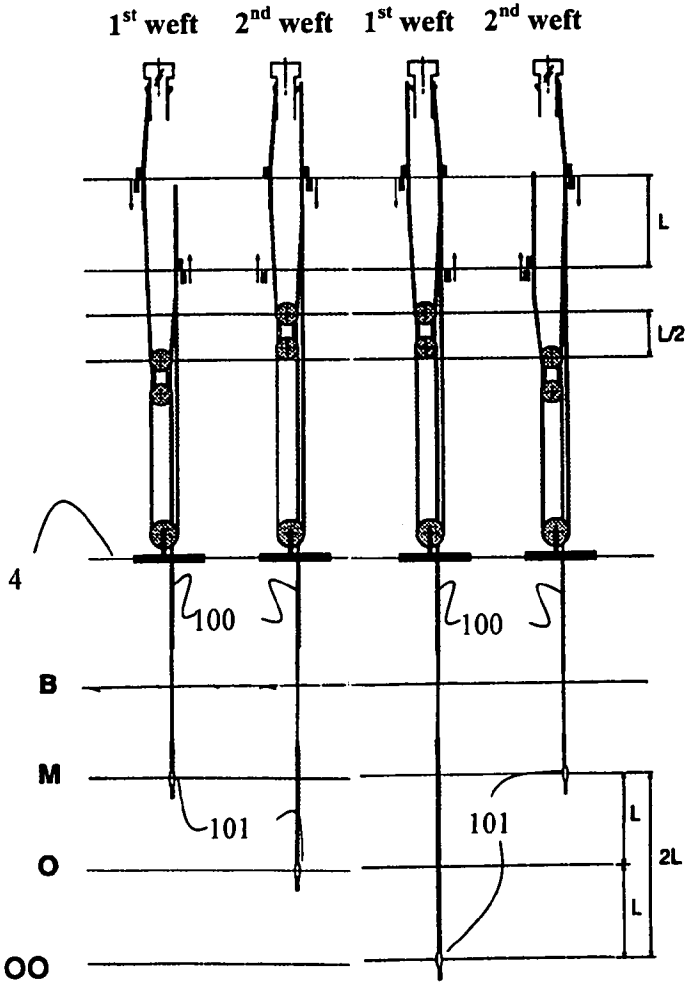
FIG. 5 is representing the tackle system and the selective options of a three-position-non-open-shed Jacquard machine for the part equipped with a stationary grid to be used for the pile warp yarns forming zones with floating pile across several weft yarns in the lower fabric.
Figure 4:
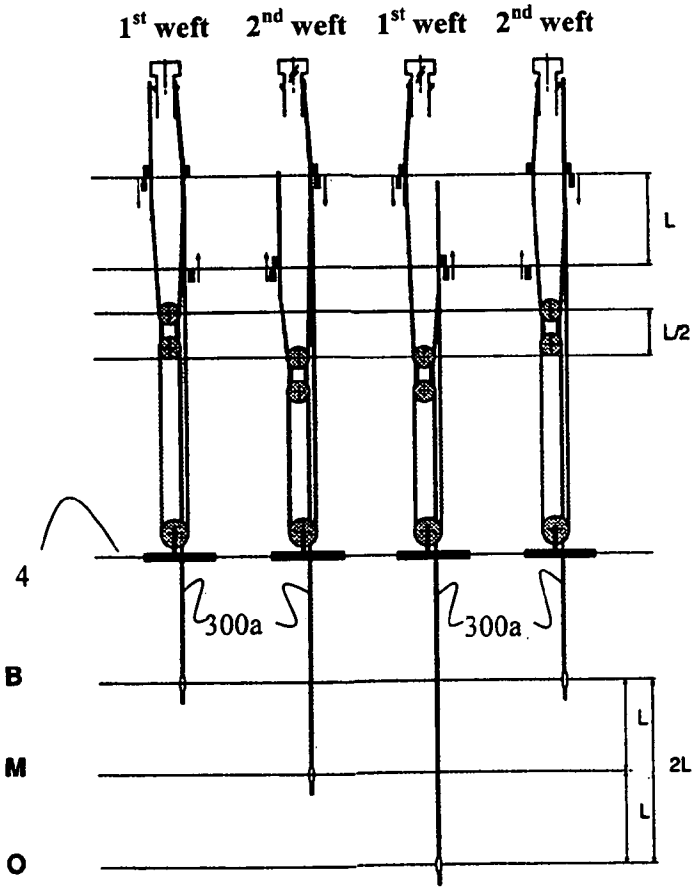
FIG. 4 is representing the tackle system and the options of a three-position-non-open-shed Jacquard machine for the part equipped with a stationary grid to be used for the pile warp yarns forming the cut pile and which are woven in the upper fabric as dead pile.
Figure 7:
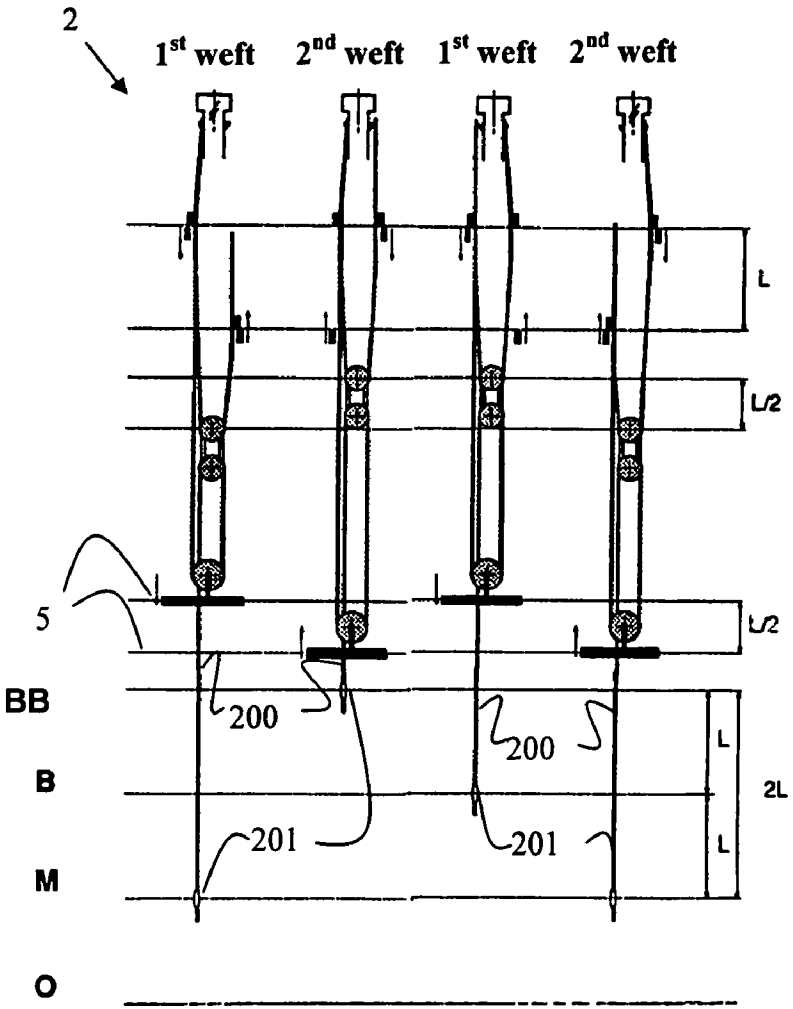
FIG. 7 is representing the tackle system and the selective options of a three-position-non-open-shed Jacquard machine for the part equipped with a movable grid to be used for the pile warp yarns forming zones with floating pile across several weft yarns in the upper fabric.
Figure 6:
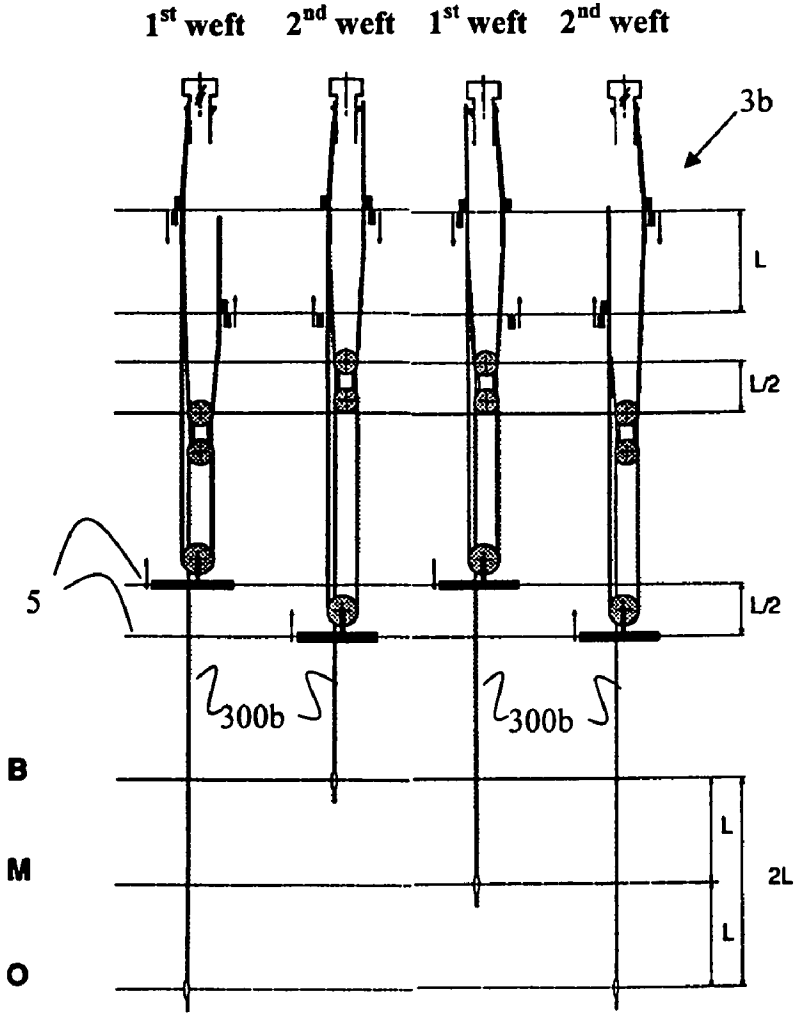
FIG. 6 is representing the tackle system and the selective options of a three-position-non-open-shed Jacquard machine for the part equipped with a movable grid to be used for the pile warp yarns forming the cut pile and which are woven in the lower fabric as dead pile.

In face-to-face weaving, the harness of the Jacquard machine serving to position the pile warp yarns, is divided into:

- a first part of the harness (1) comprising heddles (100) to position a first part of the pile warp yarns (504, 604) for the lower fabric (502, 602) (as represented in FIG. 5) and a second part of the harness comprising heddles (200) to position a second part of the pile warp yarns (503, 603) for the upper fabric (501, 601) (as represented in FIG. 7) to form zones (510, 511, 610, 514, 515, 614) with floating pile across several weft yarns (516, 518, 517, 519, 616, 617);
- a third part of the harness (3*a*, 3*b*) comprising heddles (300*a*, 300*b*) to position a third part of the pile warp yarns (507, 607, 608) to form cut pile, as represented in the FIGS. 4 and 6.

The harness cords (not represented in the figure) of the first part of the harness (1) to position the first part of the pile warp yarns (504, 604) destined for the lower fabric (502, 602), are suspended in such a way that the three positions lower, central and upper of the pile warp yarns (504, 604) are lowered by one pile warp yarn position with respect to the corresponding pile warp yarns of the third part of the pile warp yarns (507, 607, 608). In case a three-position-non-open-shed Jacquard machine according to the state-of-the-art is rearranged to a device according to the invention (as will be mentioned later on), the harness device for the first part of the pile warp yarns (504, 604) to form zones (514, 515, 614) with floating pile across several weft yarns (517, 519, 617) in the lower fabric (502, 602) is taken from the part of the pile warp yarns, which are connected to the stationary grid. Their corresponding warp yarns are the pile warp yarns (507, 608) in the three-position-non-open-shed Jacquard machine according to the state-of-the-art on the stationary grid. For the second part of the warp yarns (603, 603) to form zones (510, 511, 610) with floating pile across several weft yarns (516, 517, 616) in the upper fabric (501, 601), the pile warp yarns (607) which are connected to the movable grid in the three-position-non-open-shed Jacquard machine according to the-state-of-the-art, are the corresponding warp yarns. The harness cords of the second part of the harness (2) for positioning the second part of the pile warp yarns (503, 603), destined for the upper fabric (501, 601), are suspended in such a manner that the three positions lower, central and upper of the pile warp yarns (503, 603) are raised by one pile warp yarn position with respect to the corresponding pile warp yarns (507, 607, 608).

The said first part of the pile warp yarns (504, 604) are controlled by the part of the Jacquard machine with the stationary grid (4) (as represented in FIG. 5), whereas the second part of the pile warp yarns (503, 603) are controlled by the part of the Jacquard machine with the movable grid (5) (as represented in FIG. 7).

The said third part of the pile warp yarns (507, 607, 608) are again divided into two groups, being;

a first group of pile warp yarns (607) for weaving cut pile, which are controlled by the part of the Jacquard machine with the stationary grid (4), the harness cords of the corresponding part of the harness (3*a*) for positioning this first group of pile warp yarns (607) destined for the upper fabric (501, 601) being suspended according to the-state-of-the-art, the three positions lower, central and upper of the pile warp yarns corresponding with the positions lower (O), central (M) and upper (B) with respect to the weft insertion levels.;

a second group of pile warp yarns (507, 608) for weaving cut pile, which are controlled by the part of the Jacquard machine with the movable grid (5), the harness cords of the corresponding part of the harness (3*b*) for positioning this second group of pile warp yarns (507, 608) destined for the lower fabric (502, 602) being suspended according to the-state-of-the-art, the three positions lower, central and upper of the pile warp yarns corresponding with the positions lower (O), central (M) and upper (B) with respect to the weft insertion levels.

In order to weave fabrics comprising one or several zones (510, 511, 610, 514, 515, 614) with flat weave by means of current face-to-face, double-rapier weaving machines with three-position-non-open-shed Jacquard machines, whereas in this flat weave part, pile warp yarns (503, 603, 504, 604) are floating across several weft yarns (516, 518, 616, 517, 519, 617), the invention is providing a method to rearrange the suspension of the harness of a three-position-non-open-shed Jacquard machine according to the state-of-the-art. A suspension of the harness of a three-position-non-open-shed Jacquard machine according to the state-of-the-art is provided with heddles for positioning pile warp yarns of one or more frames, two weft yarns (505, 605, 506, 606) being inserted simultaneously between the said warp yarns (520, 620, 530, 630) at different weft insertion levels by a weaving machine in successive operating cycles. Furthermore, the harness suspension is provided to maintain the pile warp yarns (503, 603, 504, 604) of one or several frames in an upper and/or a lower position in successive operating cycles of the weaving machine. Such a harness suspension is rearranged to a harness suspension which is provided in such a manner that the pile warp yarns (503, 603, 504, 604) of one or several frames being maintained in the upper and/or lower position, are lowered or raised respectively by one pile warp yarn position.

Rearranging the suspension of the harness of a three-position-non-open-shed Jacquard machine according to the-state-of-the-art may be done in different ways.

For one thing, the heddles of the pile warp yarns of one or several of the frames mentioned above may be replaced by heddles (100, 200) the heddle eyes (101, 201) may be lowered (see FIG. 5) or raised (see FIG. 7) respectively by the distance of one position with respect to the weft insertion levels. In face-to-face weaving (as represented in FIG. 5), the heddles of the pile warp yarns of the one or several frames of a three-position-non-open-shed Jacquard machine according to the-state-of-the-art for weaving zones (514, 515, 614) with floating pile across several weft yarns (517, 519, 617) for the lower fabric (502, 602), are replaced by heddles (100), the heddle eyes (101) of which are situated lower by one position of the pile warp yarn. For weaving zones (510, 511, 610) with floating pile across several weft yarns (516, 518, 616) for the upper fabric (501, 601) (as represented in FIG. 7), the heddles of the pile warp yarns of the one or several frames of the harness suspension of a three-position-non-open-shed Jacquard machine according to the-state-of-the-art are replaced by heddles (200), the heddle eyes (201) of which are situated higher by one pile warp yarn position.

On the other hand, the pile warp yarns (503, 603, 504, 604) of at least one frame of the said frames, may be suspended to a sectional part adjustable as to height (not represented in the figure), in order to be able to lower or raise respectively the pile warp yarns of the said frames (503, 603, 504, 604) which may be maintained in the upper and/or lower position, by one pile warp yarn position, because of which the pile warp yarns of this at least one frame, in a first situation of the adjustable sectional part, may be used to extend between the lower fabric and the upper fabric (501, 601) and therefore to form cut pile, and in a second situation of the adjustable sectional part, may be used to float across several weft yarns (504, 604, 503, 603) in the upper and lower fabric (501, 601, 502, 602). In case the pile warp yarns of this frame are connected to the movable grid (5) of the Jacquard machine (see FIG. 7), then this sectional part is provided to be adjusted upwards by one position of the pile warp yarn when rearranging its availability to be used as cut pile to its being available to be used as floating pile across several weft yarns (516, 518, 616) in the upper fabric (501), 601). In case the pile warp yarns of this frame are connected to the stationary grid (4) of the Jacquard machine (see FIG. 5), then this sectional part is provided to be adjusted downwards by one position of the pile warp yarn when rearranging its availability to be used as cut pile to its being available as floating pile across several weft yarns (517, 519, 617) in the lower fabric (502), 602). Adjusting the sectional part can be effected both manually per frame and by means of a drive per frame or for several frames simultaneously. In the driven embodiment, driving may occur by operating the drive manually as well as by activating it from the operating device of the machine. Activating by the operating device of the machine can also be defined by the weaving pattern by modifying, either between two fabrics or even within the fabric itself, the pattern forming pile warp yarns for the flat weave part with the zones (510, 511, 610, 514, 515, 614) with floating pile across several weft yarns (516, 518, 517, 519, 616, 617).

Activating may be performed by electro-hydraulic, electro-pneumatic or electro-mechanical means.

The invention claimed is:

1. Method for weaving fabrics (501, 502, 601, 602) on a weaving machine, comprising in successive weft insertion cycles two weft yarns (505, 506, 605, 606) simultaneously inserted at different weft insertion levels between pile warp yarns (520, 530, 620, 630) which are positioned with respect to the welt insertion levels by means of a three-position-non-open-shed Jacquard machine, wherein the Jacquard machine is provided to maintain one or several pile warp yarns (503, 504, 603, 604) in successive operating cycles of the waving machine in an upper and/or a lower position, wherein the said pile warp yams (503, 504, 603, 604) in their upper or in their lower position are positioned between the welt insertion levels, wherein for face-to-face weaving, at least a first part of the said pile warp yarns (503, 603) are positioned in their upper position between the weft insertion levels, and at least a second part (504, 604) of the said pile warp yarns are positioned in their lower position between the weft insertion levels, and wherein to form zones (511)

with floating pile across several weft yarns (518) at the back of the upper fabric (501), at a first weft the pile warp yarns of the second part (503) are positioned in a central position which corresponds with a position of the pile warp yarns (503) above the weft insertion levels, and at a second weft are positioned in an upper position which corresponds with an uppermost position of the pile warp yarns (503) with respect to the weft insertion levels.

2. Method according to claim 1, characterized in that to form zones (515) with floating pile across several weft yarns (519) at the back of the lower fabric (502), at a first weft, the pile warp yarns (504) are positioned in a central position which corresponds with a position of the pile warp yarns (504) below the weft insertion levels, and at a second weft are positioned in an lower position which corresponds with lowermost position of the pile warp yarns (504) with respect to the weft insertion levels.

3. Method according to claim 1, characterized in that the positions of the pile warp yarns (503, 504) corresponding with the lowermost and the uppermost position of the pile warp yarns (503, 504) with respect to the weft insertion levels are disengaged or adjusted as impossible to be selected when activating the Jacquard machine.

4. Method according to claim 1, characterized in that at least a third part (507, 607, 608) of the pile warp yarns are alternately interlaced across weft yarns (505, 605, 506, 606) in the backing fabric of the upper and lower fabric (501, 601) and (502, 602) respectively and form a pile, the pile forming pile warp yarns (507, 607, 608) being cut through between the two fabrics (501, 601, 502, 602), such that two fabrics (501, 601, 502, 602) with at least one zone with cut pile are formed.

5. Three-position-non-open-shed Jacquard machine, wherein the Jacquard machine is provided for positioning pile warp yarns such that two weft yarns (505, 506, 605, 606) are simultaneously inserted at a different weft insertion level between the said pile warp yarns (520, 620, 530, 630) by means of a weaving machine in successive weft insertion cycles, and wherein the Jacquard machine is provided to maintain one or several pile warp yarns (503, 504, 603, 604) in successive operating cycles of the weaving machine in an upper and/or lower position, and wherein the Jacquard machine is provided to position the said pile warp yarns (503, 504, 603, 604) in their upper or in their lower positions between the weft insertion levels.

6. Three-position-non-open-shed Jacquard machine wherein the, Jacquard machine is provided for position pile warp yarns such that two weft yarns (505, 506, 605, 606) are simultaneously inserted at a different weft insertion level between the said pile warp yarns (520, 620, 530, 630) by means of a weaving machine in successive weft insertion cycles, wherein the Jacquard machine is provided to maintain one or several pile warp yarns (503, 504, 603, 604) in successive operating cycles of the weaving machine in an upper and/or lower position, wherein the Jacquard machine is provided to position the said pile warp yarns (503, 504, 603, 604) in their upper or in their lower positions between the weft insertion levels, and wherein with face-to-face weaving, the harness of the Jacquard machine which is provided to position the pile warp yarns (503, 504, 603, 604) are divided into:

a first and a second part of the harness (1 and 2 respectively) comprising heddles (100 and 200 respectively) for positioning a first and a second part of pile warp yarns (504, 604 and 503, 603 respectively) to form zones (510, 511, 610, 514, 515, 614) with floating pile across several weft yarns (516, 518, 517, 519, 616, 617), wherein the harness cords of the first part of the harness (1) for positioning the first part of the pile warp yarns (504, 604) destined for the lower fabric (502, 602), are suspended in such a manner that the three positions lower, central and upper of the warp yarns (504, 604) are lowered by one position with respect to the corresponding pile warp yarns of the third part of the warp yarns (507, 607), 608), and the second part of the harness (2) for positioning the second part of the pile warp yarns (503, 603) destined for the upper fabric (501, 601), will be suspended in such a manner that the three positions lower, central and upper, of the pile warp yarns (603, 603) are raised by one position with respect to the corresponding pile warp yarns of the third part of the pile warp yarns (507, 607, 608);

a third part of the harness (3*a*, 3*b*), comprising heddles (300*a*, 300*b*) for positioning a third part of the pile warp yarns (507, 607, 608) in order to form cut pile.

7. Three-position-non-open-shed Jacquard machine according to claim 6, characterized in that the said first part of pile warp yarns (504, 604) is controlled by the part of the Jacquard with a stationary grid, and the said second part of the pile warp yarns (503, 603) is controlled by the part of the Jacquard machine with the movable grid.

8. Weaving machine method for weaving fabrics (501, 502, 601, 602), comprising in successive weft insertion cycles two weft yarns (505, 506, 605, 606) are simultaneously inserted at different weft insertion levels between pile warp yarns (520, 530, 620, 630) which are positioned with respect to the weft insertion levels by means of a three-position-non-open-shed Jacquard machine, wherein the Jacquard machine is provided to maintain one or several pile warp yarns (503, 504, 603, 604) in successive operating cycles of the weaving machine in an upper and/or a lower position, wherein the said pile warp yarns (503, 504, 603, 604) in their upper or in their lower position are positioned between the weft insertion levels, wherein for face-to-face weaving, at least a first part of the said pile warp yarns (503, 603) are positioned in their upper position between the weft insertion levels, and at least a second part (504, 604) of the said pile warp yarns are positioned in their lower position between the weft insertion levels.

9. Weaving machine method according to claim 8, characterized in that the weaving machine is a face-to-face double-rapier weaving machine.

10. Method for rearranging the harness suspension of a three-position-non-open-shed Jacquard machine, wherein the harness suspension is provided with heddles to position pile warp yarns (520, 620, 530, 630) of one or several frames, wherein two weft yarns (505, 605, 506, 606) are inserted simultaneously by a weaving machine in successive weft insertion cycles at a different weft insertion level between the said pile warp yarns (520, 620, 530, 630) and which is provided to maintain the pile warp yarns (503, 603, 504, 604) of one or several frames in successive operating cycles of the weaving machine in an upper and/or a lower position, characterized in that the harness suspension is provided such that the pile warp yarns (504, 604, 503, 603) of the one or several frames which are maintained in the upper and/or lower position are lowered or raised respectively by one position of the pile warp yarn.

11. Method for rearranging the harness suspension of a three-position-non-open-shed Jacquard machine according to claim 10, characterized in that the heddles of the pile warp yarns (504, 604, 503, 603) of the one or several frames are replaced by heddles, the heddle eyes of which are lowered or raised respectively by the distance of one position of the pile warp yarn.

12. Method for rearranging the harness suspension of a three-position-non-open-shed Jacquard machine according to claim 11, characterized in that, for weaving one or several zones (514, 515, 614) with floating pile across several weft yarns (517, 519, 617) for the lower fabric (501, 502), the heddles of the pile warp yarns (504, 604) of the said one or several frames are replaced by heddles, the heddle eyes of which are situated lower by one position of the pile warp yarn.

13. Method for rearranging the harness suspension of a three-position-non-open-shed Jacquard machine according to claim 11, characterized in that, for weaving one or several zones (510, 511, 610) with floating pile across several weft yarns (516, 518, 616) for the upper fabric (501, 601), the heddles of the pile warp yarns of the said one or several frames are replaced by heddles, the heddle eyes of which are situated higher by one position of the pile warp yarn.

14. Method for rearranging the harness suspension of a three-position-non-open-shed Jacquard machine according to claim 10, characterized in that the pile warp yarns of at least one frame of the said frames are suspended to a sectional part which is adjustable as to height, in order to be able to lower, respectively raise by one position the pile warp yarns (503, 603, 504, 604) of the said frame which may be maintained in the upper andlor lower position, through which the pile yarns of this at least one frame in a first situation of the adjustable sectional part may be used to extend between the lower fabric (502, 602) and the upper fabric (501, 601), and in a second situation of the adjustable sectional part may be used to float across several weft yarns (504, 604, 503, 603) in the upper or lower fabric (501, 601, 502, 602).

15. Method for rearranging the harness suspension of a three-position-non-open-shed Jacquard machine according to claim 14, characterized in that, in case the pile warp yarns of this frame are connected to the movable grid of the Jacquard machine, this sectional part is provided to be adjusted upwards by one position when rearranging it from being used as cut pile to its use as floating pile across several weft yarns (516, 518, 616) in the upper fabric (501, 601).

16. Method for rearranging the harness suspension of a three-position-non-open-shed Jacquard machine according to claim 14, characterized in that, in case the pile warp yarns of this frame are connected to the stationary grid of the Jacquard machine, this sectional part is provided to be adjusted downwards by one position when rearranging it from being used as cut pile to its use as floating pile across several weft yarns (517, 519, 617) in the lower fabric (502, 602).

17. Method for rearranging the harness suspension of a three-position-non-open-shed Jacquard machine according to claim 14, characterized in that rearranging the sectional part occurs manually per frame.

18. Method for rearranging the harness suspension of a three-position-non-open-shed Jacquard machine according to claim 14, characterized in that rearranging the sectional part occurs per frame or per several frames simultaneously by means of a drive.

19. Method for rearranging the harness suspension of a three-position-non-open-shed Jacquard machine according to claim 18, characterized in that the drive is manually operated.

20. Method for rearranging the harness suspension of a three-position-non-open-shed Jacquard machine according to claim 18, characterized in that the drive is operated by the controller of the machine.

21. Method for rearranging the harness suspension of a three-position-non-open-shed Jacquard machine according to claim 18, characterized in that controlling occurs by electro-hydraulic, electro-pneumatic or electro-mechanical means.

* * * * *